US006196478B1

(12) United States Patent
McPherson, Jr.

(10) Patent No.: US 6,196,478 B1
(45) Date of Patent: Mar. 6, 2001

(54) COATING SYSTEM FLUID SUPPLY CYLINDER WITH IMPROVED FLUSHABILITY

(75) Inventor: Jerry L. McPherson, Jr., Greenfield, IN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/085,624

(22) Filed: May 27, 1998

(51) Int. Cl.[7] ..... B05B 5/00

(52) U.S. Cl. ..... 239/690; 239/305; 239/320; 239/708; 92/164; 222/148; 222/334; 118/629

(58) Field of Search ..... 239/112, 302, 239/690, 708, DIG. 14, 320, 321, 322, 329, 331, 334, 305; 118/302, 621, 629; 92/163, 164, 169.1; 222/148, 334

(56) References Cited

U.S. PATENT DOCUMENTS

| | | | | |
|---|---|---|---|---|
| 1,605,075 | * | 11/1926 | Shaff | 92/164 X |
| 2,826,467 | * | 3/1958 | Ballard | 92/164 |
| 2,973,744 | * | 3/1961 | Hennells | 92/164 X |
| 3,181,429 | * | 5/1965 | Washbond | 92/164 X |
| 3,185,043 | * | 5/1965 | Dunham | 92/164 |
| 4,313,475 | | 2/1982 | Wiggins . | |
| 5,078,168 | | 1/1992 | Konieczynski . | |
| 5,255,856 | * | 10/1993 | Ishibashi et al. | 239/690 X |
| 5,288,029 | * | 2/1994 | Ishibashi et al. | 239/708 X |
| 5,326,031 | * | 7/1994 | Konieczynski | 239/708 X |
| 5,364,035 | | 11/1994 | Ma et al. . | |
| 5,632,816 | | 5/1997 | Allen et al. . | |

* cited by examiner

*Primary Examiner*—Andres Kashnikow
*Assistant Examiner*—Steven J. Ganey
(74) *Attorney, Agent, or Firm*—John P. O'Brien; Mark W. Croll; Donald J. Breh

(57) ABSTRACT

A fluid supply cylinder with improved flusbability, useable for supplying paints to a dispenser in electrostatic coating systems. The fluid supply cylinder having generally a piston reciprocatingly disposed in a chamber of a body member, the piston having a head with a face opposite an end wall of the chamber, a plurality of chamber fluid ports disposed in the end wall of the chamber, and a plurality of fluid conduits between a corresponding one of the plurality of chamber fluid ports and a common outer fluid port, whereby the reciprocating piston draws fluid into the cylinder chamber and supplies fluid from the cylinder chamber through the plurality of chamber fluid ports in the end wall thereof.

18 Claims, 3 Drawing Sheets

COATING SYSTEM FLUID SUPPLY CYLINDER WITH IMPROVED FLUSHABILITY

BACKGROUND OF THE INVENTION

The invention relates generally to coating systems having piston operated fluid supply cylinders, and more particularly to fluid supply cylinders useable for supplying liquid paints to dispensers.

Fluid supply systems that supply fluid from one or more piston operated fluid supply cylinders are known generally and used widely. U.S. Pat. No. 5,632,816 issued May 27, 1997, entitled "Voltage Block" and U.S. Pat. No. 5,725,150 issued on Mar. 10, 1998, entitled "Method and System for an Improved Voltage Block", both assigned commonly herewith and incorporated herein by reference, for example, disclose generally electrostatic coating systems having one or more cylinders with reciprocating pistons for pumping paints to an electrostatic dispenser that sprays atomized and electrically charged paint particles toward a target. A voltage blocking valve directs the supply of paint from a reservoir to the cylinder and to the electrostatic dispenser. The cylinder is generally selectively coupled to one of several different paint reservoirs to permit changing paints supplied therefrom to the electrostatic dispenser. Between paint changes, the cylinder is flushed with solvent to remove any paint and paint residue therefrom and from associated supply conduits.

In known prior art fluid supply cylinders, fluid is drawn into a cylinder chamber through a single fluid port disposed through an end wall of the cylinder while the piston moves away therefrom, and fluid is supplied from the cylinder chamber through the fluid port while the piston moves toward the end wall. In prior art fluid supply cylinders, however, fluid residue has a tendency to accumulate on portions of the cylinder chamber, and particularly on the piston head face opposite the end wall of the cylinder chamber. The accumulation of residue, especially paint residue, can become relatively heavy and difficult to remove, particularly after prolonged operation.

It is known to remove paint residue from fluid supply cylinders by flushing the cylinder chamber with a solvent, for example between paint color changes in the electrostatic systems disclosed in the referenced U.S. Pat. Nos. 5,632,816 and 5,725,150. In prior art cylinders, however, the solvent tends to remove residue accumulated on the central portion of the piston head opposite the fluid inlet port most effectively. Fluid is removed less effectively from other portions of the cylinder chamber including portions of the piston face located radially outwardly of the central portion thereof. To completely remove residue from the cylinder chamber and piston head, at least to an extent necessary to prevent cross contamination of different fluids supplied therefrom, substantial amounts of solvent must be pumped or flushed through the cylinder chamber. But solvent and the disposal thereof is costly, so it is generally desirable to minimize solvent usage. Increased solvent flushing also requires more time, which reduces productivity.

The present invention is drawn generally toward advancements in the art of piston operated fluid supply cylinders, and more particularly to fluid supply cylinders with improved flushability, and useable for supplying fluids in coating systems.

It is an object of the invention to provide novel piston operated fluid supply cylinders that overcome problems with the prior art.

It is also an object of the invention to provide novel piston operated fluid supply cylinders with improved flushability, useable for supplying liquid paints in coating systems, and combinations thereof.

It is another object of the invention to provide novel piston operated fluid supply cylinders that may be flushed relatively quickly and with relatively reduced amounts of solvent, and that are useable for supplying paints in electrostatic coating systems capable of flushing paint residue from the fluid supply cylinder.

It is a more particular object of the invention to provide a fluid supply cylinder comprising generally a piston reciprocatingly disposed in the chamber of a body member, the piston having a head with a face opposite an end wall of the chamber, a plurality of chamber fluid ports disposed in the end wall of the chamber, whereby the reciprocating piston draws fluid into the cylinder and supplies fluid from the chamber through the plurality of chamber fluid ports.

It is another more particular object of the invention to provide novel fluid supply cylinders of the type discussed generally above, further comprising an outer fluid port in the body member, and a plurality of fluid conduits between a corresponding one of the plurality of chamber fluid ports and the outer fluid port. The outer fluid port is preferably located substantially along a central axis of the cylinder chamber, and at least some of the plurality of fluid conduits preferably diverge outwardly from the outer fluid port toward the end wall of the chamber.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

The piston operated fluid supply cylinders of the present invention are disclosed in the context of an electrostatic coating system, as discussed further below. The fluid supply cylinders of the present invention however are applicable more generally to many other systems and applications, besides electrostatic coating systems that require the supply of fluids, including liquids, gasses, and flowable solids.

Figure 1:
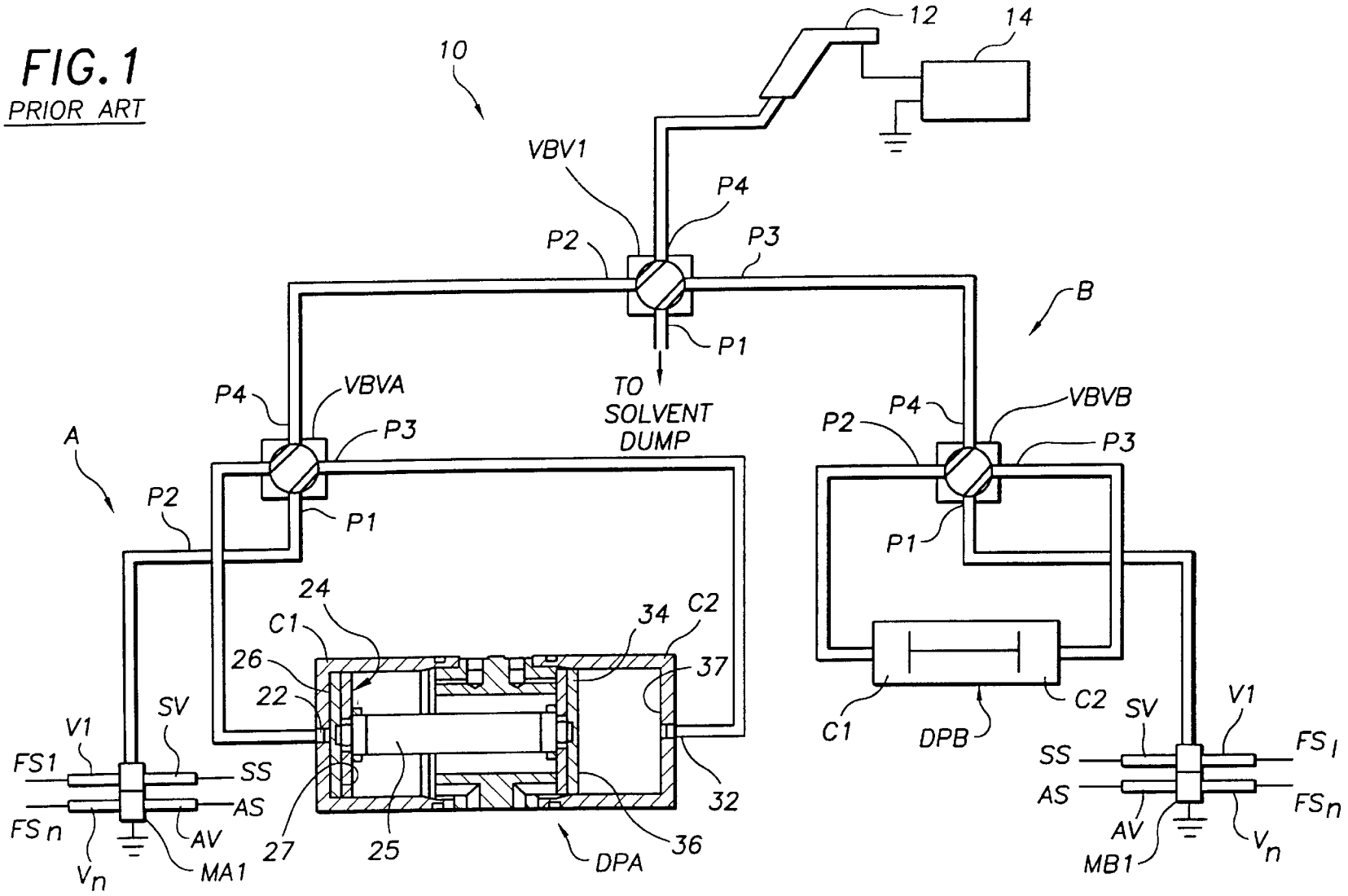
FIG. 1 PRIOR ART
FIG. 1 is an electrostatic coating system having a prior art fluid supply cylinder.

FIG. 1 illustrates a prior art electrostatic coating system 10 having a parallel arrangement of subsystems A and B each having a corresponding prior art fluid supply cylinder DPA and DPB alternately coupled to the dispenser 12 by a system voltage blocking valve VBV1, as disclosed generally below and more fully in the referenced U.S. Pat. No. 5,632,816 entitled "Voltage Block" and U.S. Pat. No. 5,725,150 entitled "Method and System for an Improved Voltage Block". The piston operated fluid supply cylinders of the present invention may for example replace the prior art fluid supply cylinders DPA and DPB in FIG. 1.

In FIG. 1, the prior art double piston cylinder DPA illustrates the basic components of the double piston cylinders in the respective subsystems A and B, many of which are common to the fluid supply cylinders of the present invention, as discussed further below. The double piston cylinder DPA comprises generally two self-contained first and second cylinders C1 and C2 with respective outer fluid ports 22 and 32 in a corresponding head portion of the cylinder, and coupled to the fluid reservoirs as discussed further below. Each cylinder includes a corresponding piston 24 and 34 coupled to a common connecting rod or shaft 25 that permits reciprocating action of the pistons in the respective cylinders. The pistons are reciprocated by the alternating supply of fluid through the ports P2 and P3 of a valve VBVA, as discussed below, or by other means. The double piston cylinder DPB is configured identically. Alternative cylinders configured with a single piston are also known generally and disclosed more fully in the referenced U.S. Pat. No. 5,632,816 entitled "Voltage Block".

Figure 2:
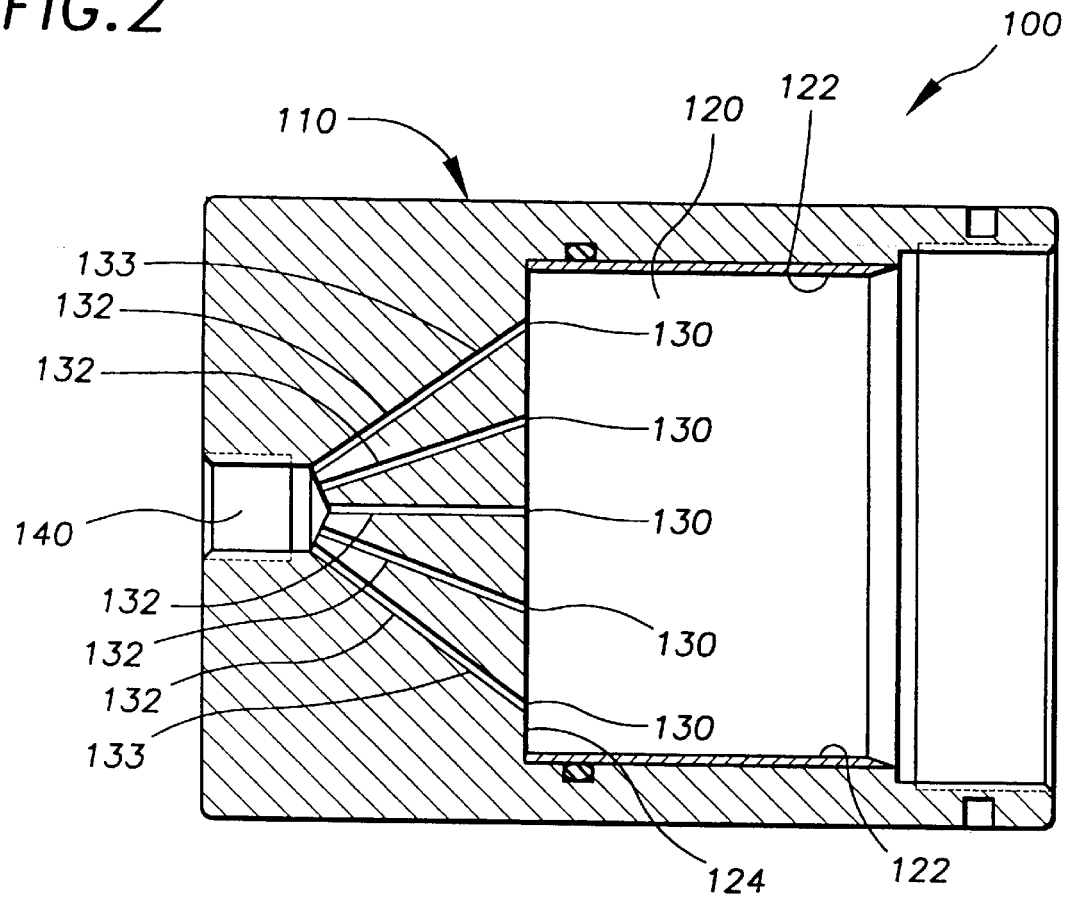
FIG. 2 is a partial sectional view of a fluid supply cylinder according to an exemplary embodiment of the invention.
Figure 4:
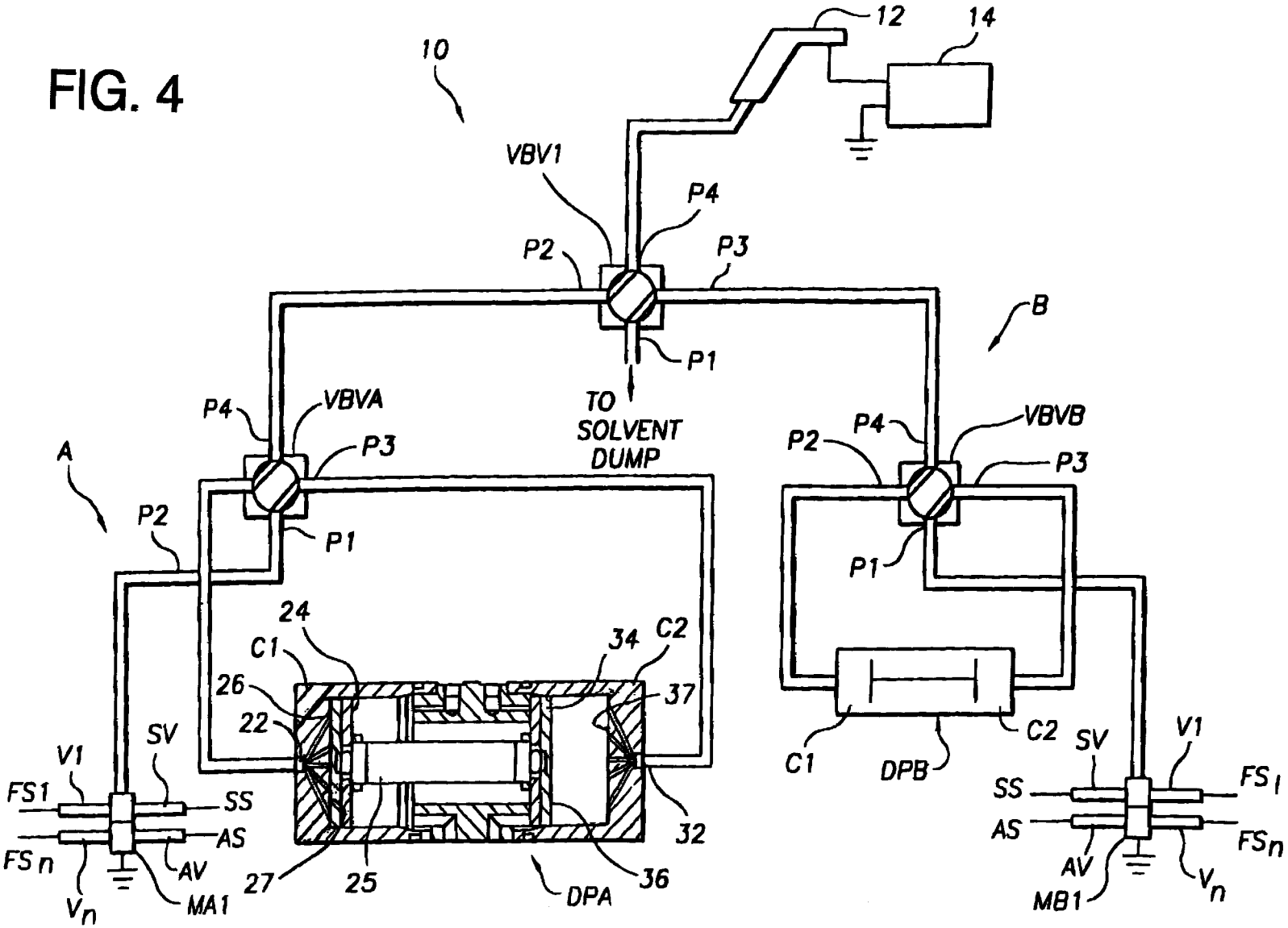
FIG. 4 is an electrostatic coating system having fluid supply cylinders according to the present invention.

FIG. 2 is a partial sectional view of a fluid supply cylinder 100 according to an exemplary embodiment of the invention, useful especially for supplying paints in electrostatic coating systems of the type illustrated in the exemplary system of FIG. 4. The fluid supply cylinder 100 comprises generally a body member 110 having a chamber 120 with a substantially cylindrical side wall 122 and an end wall 124. The exemplary body member 110 may be part of the double piston cylinders DPA and DPB illustrated in FIG. 4, or alternatively part of a single piston cylinder.

A piston, not shown in FIG. 2 for clarity but known generally and illustrated in FIG. 4, is reciprocatingly disposed in the chamber 120 of the body member 110. FIG. 4 illustrates each piston 24 and 34 of the double piston cylinder DPA having corresponding heads with faces 26 and 36 opposite corresponding end walls 27 and 37 of the cylinders C1 and C2.

Figure 3:
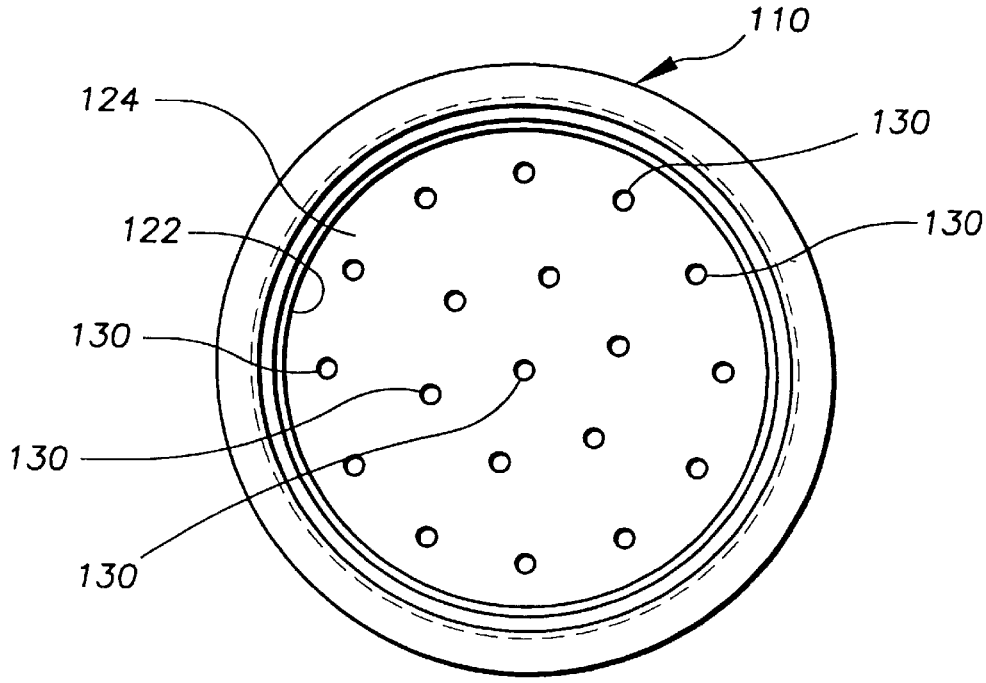
FIG. 3 is an end view of the fluid supply cylinder of FIG. 2.

FIGS. 2 and 3 illustrate a plurality of chamber fluid ports 130 disposed in the end wall 124 of the fluid supply cylinder 100. FIG. 2 illustrates the plurality of chamber fluid ports 130 coupled to a common outer fluid port 140 in the body member 110 by a corresponding plurality of fluid conduits 132 disposed interconnectedly therebetween. The outer fluid port 140 has generally a diameter greater than a diameter of the plurality of chamber fluid ports 130 and the corresponding conduits 132 therebetween, whereby fluid flow into and out of the chamber 120 is controlled by appropriately sizing the diameters of the outer fluid port 140, the fluid conduits 132, and ports 130.

In FIG. 2, the outer fluid port 140 is preferably located substantially along a central axis of the cylinder chamber 120, and at least some of the plurality of fluid conduits 132, for example conduits 133 corresponding to the plurality of fluid ports 130 located radially outwardly of the central axis, diverge outwardly from the outer fluid port 140 toward the end wall 124 of the chamber, where the fluid conduits 132 form the plurality of fluid ports 130 opening into the chamber 120. In some embodiments, the fluid conduits 132 may diverge outwardly at various angles to better distribute solvent along the cylindrical side wall 122.

FIG. 3 illustrates the plurality of chamber fluid ports 130 preferably distributed substantially uniformly over a surface of the cylinder chamber end wall 124. In the exemplary embodiment, which is suitable for electrostatic coating systems applications, nineteen chamber fluid ports 130 are disposed on the chamber end wall 124 with a corresponding number of fluid conduits 132. Other embodiments may have more or less chamber fluid ports 130 on the end wall 124, as the particular application requires. Generally, the more chamber fluid ports 130, the smaller will be the diameter thereof and the smaller the diameter of the corresponding fluid conduits 132.

In operation, the reciprocating piston draws fluid from the outer fluid port 140, through the plurality of fluid ports 130 and into the chamber 120 as the piston is retracted away from the chamber end wall 124, and the reciprocating piston supplies fluid from the chamber 120 through the plurality of chamber fluid ports 130 and to the outer fluid port 140 as the piston moves toward the chamber end wall 124.

The plurality of chamber fluid ports 130 disposed in the end wall 124 of the chamber 120 more evenly distribute fluid supplied into the chamber, which is advantageous for flushing paint and paint residue from the chamber 120 with solvents. Generally, the divergent flow of fluid into the chamber 120 tends to better circulate fluid therein, thereby increasing the efficacy with which paint and paint residue is removed therefrom during flushing. More particularly, solvent flow into the chamber 120 through the plurality of chamber fluid ports 130 distributes the solvent relatively evenly over the face of the piston opposite the end wall 124 of the chamber 120, and at various angles of incidence, thereby more effectively removing paint and paint residue therefrom. The radially outwardly diverging conduits 133 direct solvent outwardly toward portions of the cylindrical side wall 122, thereby increasing the efficacy with which paint and paint residue is removed therefrom. Also, as solvent is pumped from the chamber 120, fluid entering the plurality of fluid ports 130 creates additional turbulence which further facilitates removal of paint and paint residue from the chamber 120. The plurality of chamber fluid ports 130 thus reduce the amount of solvent required to flush paints and residue from the chamber 120, and also reduce the time required to perform the flushing operation.

In the exemplary application of FIG. 4, each subsystem A and B includes a corresponding manifold MAI and MB1 at a first electrical potential coupled to one or more selectable fluid supply reservoirs FS1 through FSn not shown in the drawing, by corresponding valves V1 through Vn. A solvent supply SS is also coupled to each manifold MA1 and MB1 by a corresponding solvent supply valve SV. Each manifold MA1 and MB1 is coupled to a port P1 of a corresponding voltage blocking valve VBVA and VBVB having ports P2 and P3 coupled to cylinders C1 and C2 of corresponding double piston cylinders DPA and DPB. Port P4 of each voltage blocking valve VBVA and VBVB is coupled to ports P2 and P3, respectively, of the system voltage blocking valve VBV1. A fourth port P4 of the system valve VBV1 is coupled to a trigger actuatable fluid dispenser 12 maintainable at a second electrical potential by a high voltage power supply 14.

In FIG. 4, the valve VBVA rotates to alternately couple one of the cylinders C1 and C2 to the fluid reservoir through manifold MA1 and to alternately couple the other cylinder C2 and C1 to the fluid dispenser 12, whereby fluid is supplied to one cylinder C1 or C2 from the reservoir, while the other cylinder C2 or C1, supplies fluid to the dispenser 12. The cylinders C1 and C2 may also be coupled to the solvent supply SS through the manifold MA1 to flush paint from the cylinders C1 and C2 between paint changes. Other manifolds and valves, not shown, flush paint from the dispenser 12. These and other incidental aspects of the exemplary electrostatic system 10 are discussed more fully in the referenced U.S. Pat. No. 5,632,816 entitled "Voltage Block" and U.S. Pat. No. 5,725,150 entitled "Method and System for an Improved Voltage Block".

The piston operated fluid supply cylinders of the present invention substantially reduce the amount of solvent required to flush paints and residue therefrom, and also reduce the time required to perform the flushing operation between paint changes in electrostatic coating systems of the type illustrated generally in FIG. 4, and are beneficial in other fluid supply systems as well.

While the foregoing written description of the invention enables one of ordinary skill to make and use what is considered presently to be the best mode thereof, those of ordinary skill will appreciate and acknowledge the existence of variations, combinations, and equivalents of the specific exemplary embodiments herein. The invention is therefore to be limited not by the exemplary embodiments, but by all embodiments within the scope and spirit of the appended claims.

What is claimed is:

1. A fluid supply cylinder, useable for supplying paint to a dispenser in electrostatic coating systems, the fluid supply cylinder comprising:

a body member having a chamber with an end wall;

a piston reciprocatingly disposed in the chamber of the body member, the piston having a head with a face opposite the end wall of the chamber;

a plurality of chamber fluid ports disposed in the end wall of the chamber;

an outer fluid port in the body member located substantially along a central axis of the chamber;

a plurality of fluid conduits between a corresponding one of the plurality of chamber fluid ports and the outer fluid port.

2. The fluid supply cylinder of claim 1 further comprising the chamber having a substantially cylindrical side wall.

3. The fluid supply cylinder of claim 1 further comprising the plurality of chamber fluid ports distributed substantially uniformly over the end wall.

4. The fluid supply cylinder of claim 1, at least some of the plurality of fluid conduits diverging outwardly from the outer fluid port toward the end wall of the chamber.

5. The fluid supply cylinder of claim 1, the outer fluid port having a diameter greater than a diameter of the plurality of chamber fluid ports.

6. The fluid supply cylinder of claim 1, wherein the plurality of chamber fluid ports comprise approximately nineteen chamber fluid ports.

7. An electrostatic coating system comprising:

an electrostatic dispenser;

a paint supply cylinder;

a paint reservoir interconnected to the dispenser by the paint supply cylinder, the paint supply cylinder having a body member with a chamber having an end wall, the paint cylinder having a piston reciprocatingly disposed in the chamber of the body member, the piston having a head with a face opposite the end wall of the chamber;

a plurality of chamber paint ports disposed in the end wall of the chamber.

8. The system claim 7, the plurality of chamber paint ports distributed substantially uniformly over the end wall of the chamber.

9. The system of claim 7, further comprising an outer fluid port in the body member, a plurality of fluid conduits between a corresponding one of the plurality of chamber paint ports and the outer fluid port.

10. The system of claim 9 further comprising the outer fluid port located substantially along a central axis of the chamber, at least some of the plurality of fluid conduits diverging outwardly from the outer fluid port toward the end wall of the chamber.

11. The system of claim 9 further comprising the outer fluid port having a diameter greater than a diameter of the plurality of chamber paint ports.

12. The system of claim 7 further comprising a system voltage blocking valve coupling the paint supply cylinder to the dispenser.

13. The system claim 9, wherein the plurality of chamber paint ports comprise approximately nineteen chamber paint ports.

14. An electrostatic coating system comprising:

an electrostatic dispenser;

first and second paint supply cylinders, each of the first and second paint supply cylinders having a corresponding piston reciprocatingly disposed in a chamber thereof, each of the first and second paint supply cylinders having a chamber end wall with a plurality of paint ports opposite the corresponding piston;

a voltage blocking device interconnecting the first and second paint supply cylinders and the dispenser.

15. The system of claim 14, each of the first and second paint supply cylinders having an outer fluid port and a plurality of fluid conduits interconnecting a corresponding one of the plurality of paint ports of the end wall to the outer fluid port.

16. The system of claim 15, the outer fluid port of each of the first and second paint supply cylinders is located substantially along a central axis of the chamber thereof.

17. The system of claim 15, the voltage blocking device comprises a system voltage blocking valve coupled to the dispenser and first and second voltage blocking valves coupled to the system voltage blocking valve, the first paint supply cylinder coupled to the first voltage blocking valve, the second paint supply cylinder coupled to the second voltage blocking valve.

18. The system of claim 17 further comprising a paint supply reservoir, the first and second voltage blocking valves interconnect the corresponding first and second paint supply cylinders coupled thereto to the paint supply reservoir.

* * * * *